US007011167B2

(12) United States Patent
Ebner et al.

(10) Patent No.: US 7,011,167 B2
(45) Date of Patent: Mar. 14, 2006

(54) DEVICE FOR SEALING A DRILL HOLE AND FOR DISCHARGING DRILLINGS OR STRIPPED EXTRACTION MATERIAL

(75) Inventors: Bernhard Ebner, Knittelfeld (AT); Gerhard Weinberger, Zeltweg (AT); Bruno Reumüller, Knittelfeld (AT); Barry Schmitke, Saskatoon (CA)

(73) Assignees: VOEST-ALPINE Bergetechnik Gesellschaft m.b.H., Zeltweg (AT); Cigar Lake Mining Corporation, Saskatchewan (CA)

( * ) Notice: Subject to any disclaimer, the term of this patent is extended or adjusted under 35 U.S.C. 154(b) by 195 days.

(21) Appl. No.: 10/276,273

(22) PCT Filed: May 15, 2001

(86) PCT No.: PCT/AT01/00144

§ 371 (c)(1),
(2), (4) Date: Apr. 7, 2003

(87) PCT Pub. No.: WO01/88326

PCT Pub. Date: Nov. 22, 2001

(65) Prior Publication Data

US 2003/0150610 A1 Aug. 14, 2003

(30) Foreign Application Priority Data

May 17, 2000 (AT) ..... A 864/2000

(51) Int. Cl.
*E21B 21/015* (2006.01)

(52) U.S. Cl. ..... 175/209; 175/66; 175/171; 299/12

(58) Field of Classification Search ..... 175/58, 175/60, 207, 209, 214, 215, 216, 66, 171; 166/373, 90.1, 75.15; 299/12
See application file for complete search history.

(56) References Cited

U.S. PATENT DOCUMENTS

| | | | | | |
|---|---|---|---|---|---|
| 510,517 | A | * | 12/1893 | Walker | 173/59 |
| 895,228 | A | * | 8/1908 | Bartlett | 175/206 |
| 2,107,552 | A | * | 2/1938 | Smith | 175/209 |
| 2,122,517 | A | * | 7/1938 | Curtis | 175/135 |
| 2,144,586 | A | * | 1/1939 | Kelley | 175/71 |
| 2,201,270 | A | * | 5/1940 | McIntyre | 175/209 |
| 2,279,186 | A | * | 4/1942 | Terry et al. | 175/210 |
| 2,657,016 | A | * | 10/1953 | Grable | 175/215 |
| 2,702,181 | A | | 2/1955 | Brown et al. | |
| 2,829,867 | A | * | 4/1958 | Brochetti | 175/209 |
| 2,883,155 | A | * | 4/1959 | Gehrke | 175/173 |

(Continued)

FOREIGN PATENT DOCUMENTS

DE 872185 * 12/1953

(Continued)

*Primary Examiner*—Jennifer H Gay
(74) *Attorney, Agent, or Firm*—Chapman and Cutler LLP

(57) ABSTRACT

In a device for sealing a bore hole and discharging drill cuttings and stripped excavation material, including a housing adapted to receive sealing elements and an opening capable of being connected to the bore hole, one side wall of the housing is provided with at least one opening for the connection of a haulage duct, wherein the housing end side facing the bore hole is equipped with a lockable, particularly screwable, sealing flange (13) for the detachable connection with a bore hole lining (11). The sealing flange (13) is rotationally and sealingly mounted within the housing and carries projections, in particular an annular brim (15) which is overlapped by a stop (14) of the housing.

50 Claims, 7 Drawing Sheets

U.S. PATENT DOCUMENTS 2,914,306 A * 11/1959 Failing ..... 175/210
3,045,769 A * 7/1962 Feucht et al. ..... 175/211
3,128,614 A * 4/1964 Auer ..... 464/163
3,208,539 A * 9/1965 Henderson ..... 175/215
3,400,938 A * 9/1968 Williams ..... 277/343
3,498,674 A * 3/1970 Matthews ..... 299/4
3,791,442 A 2/1974 Watkins
3,800,890 A * 4/1974 Gyongyosi et al. ..... 175/209
3,811,518 A * 5/1974 Kalaf et al. ..... 175/60
3,830,319 A * 8/1974 van der Wijden ..... 175/215
3,834,470 A * 9/1974 Gyongyosi et al. ..... 175/211
3,934,661 A * 1/1976 Sauerwein et al. ..... 175/211
3,943,997 A 3/1976 Davis
4,026,354 A 5/1977 Burrow
4,031,970 A * 6/1977 Belknap ..... 175/103
4,182,424 A * 1/1980 Prebensen ..... 175/211
4,271,916 A * 6/1981 Williams ..... 175/215
4,363,357 A * 12/1982 Hunter ..... 166/84.3
4,434,861 A * 3/1984 Howeth ..... 175/66
4,444,280 A * 4/1984 Howeth ..... 175/206
4,470,469 A * 9/1984 Coakley et al. ..... 175/170
4,529,210 A 7/1985 Biffle
4,560,001 A * 12/1985 Gonzales ..... 166/84.3
4,921,375 A * 5/1990 Famulari ..... 408/67
5,320,188 A * 6/1994 England ..... 175/206
5,380,127 A * 1/1995 Caleix et al. ..... 405/130
5,690,183 A * 11/1997 Sollami ..... 173/216
6,354,385 B1 * 3/2002 Ford et al. ..... 175/195
6,405,812 B1 * 6/2002 Tibussek ..... 175/393
2003/0111266 A1 * 6/2003 Roach ..... 175/57
2004/0035574 A1 * 2/2004 Pippert ..... 166/90.1

FOREIGN PATENT DOCUMENTS

DE 2808978 A1 * 7/1978
GB 773892 * 5/1957
SU 0715785 * 2/1980

* cited by examiner

DEVICE FOR SEALING A DRILL HOLE AND FOR DISCHARGING DRILLINGS OR STRIPPED EXTRACTION MATERIAL

BACKGROUND OF THE INVENTION

The invention relates to a device for sealing a bore hole and discharging drill cuttings and stripped excavation material, including a housing adapted to receive sealing elements and an opening capable of being connected to the bore hole, wherein one side wall of the housing is provided with at least one opening for the connection of a haulage duct and the housing end side facing the bore hole is equipped with a lockable, particularly screwable, sealing flange for the detachable connection with a bore hole lining.

Devices of the initially defined kind are used, for instance, for oil drill cuttings with a device of this type being described, for instance, in U.S. Pat. No. 4,529,210. The known devices are also denoted as blow-out preventors. However, when using same in the field of oil-drilling technology, large free spaces are usually accessible above the bore hole such that the known blow-out preventors can be relatively large-structured, having to offer a tight rotary mounting for the drill rod assembly in the first place. As a rule, the structural prerequisites of such preventors to be used in the field of oil-drilling technology, therefore, refer to the respective rotary mounting of a sealingly guided structural component which is itself designed as a coupling for the actuator of the drill rod assembly.

Devices of this type cannot be readily employed in critical drilling interventions by which a tunnel tube is made below ground and only the clear height of the tunnel tube is subsequently available as a free space, because of their dimensions, on the one hand, and because of their limited flexibility as regards the use of different elements, on the other hand. U.S. Pat. No. 5,380,127, for instance, describes a method for excavating minerals by means of a jet boring system that serves to work an ore deposit located below a lake. In that known method a tunnel tube is driven, after which, upon introduction of appropriate bores and linings, an excavation tool in the form of a liquid jet head is moved into the guiding tubes or lining tubes for the jet boring process and minerals are stripped off and carried away by the aid of high-pressure fluid and, in particular, high-pressure water. Such deposits, which call for extremely complex wallings, are to be found, for instance, in Canada, where the ore deposit would contain high concentrations of uranium ores with an accordingly high degree of contamination by radiation. Especially high demands are made on the safety and, in particular, sealing of such bores, and on top of this there is the risk in the event of natural lakes as are, for instance, found on top of such uranium ore deposits that water under high pressure might penetrate such bores and guiding tubes with a failure of the seal being likely to cause considerable contamination.

SUMMARY OF THE INVENTION

The invention aims to provide a device of the initially defined kind for a method of the above type, by which the risk of contamination of a tunnel tube can be excluded and the excavation of material is effected by flushing the ore deposit with fluid under high pressure and, in particular, high-pressure water. For such a method, the device must, therefore, not only ensure the required tightness, but also offer the opportunity to sealingly introduce via said device structural components having different diameters such as, in particular, drilling tools for making bores, tubes for lining bore holes and finally fluid tubes for feeding fluid to spraying heads or excavation heads, and to extend the same below said device by attaching respectively short sections. During all those manipulations, the required tightness must, therefore, be safeguard at any time, which is not at all feasible by a single seal such that the arrangement of different seals and the rapid exchange of such seals have to be rendered feasible. To solve this object, the device according to the invention, departing from a device of the initially defined kind, essentially consists in that the sealing flange is rotationally and sealingly mounted within the housing and carries projections, in particular an annular brim which is overlapped by a stop of the housing. Due to the fact that the sealing flange is rotationally and sealingly mounted within the housing and carries projections, in particular an annular brim which is overlapped by a stop of the housing, it is initially rendered feasible to use the blow-out preventor in a suspended manner for upwardly directed bores as will be required in the context of the method to be carried out by said device. With such a suspended arrangement, the housing itself must be sealingly connectable with the bore-hole lining and will subsequently have to be appropriately oriented for the haulage of the material to be excavated. Bearing in mind the high pressure applied, flexible hoses cannot be readily used, and an accordingly pressure-proof tube system offering high tightness will have to be employed for haulage, thus involving substantial safety-technological prerequisites not the least because of the risk of contamination in the event of untightness. The use of such rigid tight tubes, in turn, calls for the simple orientability of the device according to the invention relative to the tubes arranged within the tunnel and a relatively short structure of the same in order to enable the respectively required extension pieces for the drill rod assembly, and the tube systems required for excavation, to be installed and sealingly guided through the blow-out preventor under the restricted space conditions prevailing in the interior of the tunnel. To this end, the blow-out preventor is arranged above the drilling station, where accordingly long-structured extension units can be attached on account of the short mode of construction, whereupon, after driving of the bore, a suitable primary casing in the form of a bore-hole lining is introduced, with its lowermost element being usually fixed within the bore hole upon appropriate solidification of the bore-hole wall, for instance by pressing in concrete, after which the sealing flange can, for instance, be screwed with the final tube section. Such screwing, in turn, calls for the sealing flange to be sealingly mounting in a rotational manner in the interior of the housing.

In order to further enhance safety, the configuration advantageously is devised such that the sealing flange is surrounded by a sealing collar capable of being pressed against the edge of the bore hole in the direction of the axis of the bore hole. Such a sealing collar ensures perfect dust sealing relative to the tunnel lining already in the drilling phase and is of particular advantage as an additional safety element. The holding flange or sealing flange provides support to the preventor suspended from the rock and even at the occurrence of usual pressures of up to 70 bars acting on the seal within the preventor must intercept these pressures directly on the rock without material being diverted into the drilling station. The sealing collar, which can be pressed against the edge of the bore hole in the direction of the axis of the bore hole, advantageously is designed such that a pressure spring, in particularly a helical spring, is arranged concentric with the sealing collar surrounding the sealing flange, between the housing and a seal capable of being applied against the edge of the bore hole, said application being adjustable by means of a hydraulic cylinder and said pressure spring, particularly helical spring, ensuring an accordingly elastically resilient adaptation to the edge of the bore hole.

The device according to the invention advantageously is designed such that connections for flushing nozzles run into the interior of the housing on the side wall of the housing, wherein at least one flushing nozzle in the interior of the housing is preferably directed onto a rod assembly or a conveyor tube intended to introduce excavation fluid to a fluid-operated excavation head, and at least one flushing nozzle in the interior of the housing is preferably oriented towards the haulage duct in the tangential direction. By such specifically oriented flushing nozzles, it is, for instance, feasible to reliably flush away material adhering to the outer peripheries of parts of the drill rod assembly and tubing for the jet boring head, as the latter are being retracted, so as to safely maintain the sealing effect even during such axial displacements. By the flushing nozzles oriented substantially in the tangential direction, the haulage of the reclaimed material into the duct extending in the tunnel tube can be assisted and better diverted into the discharge channel at the material delivery, what is of particular advantage especially with high portions of drill cuttings and stripped minerals being contained in the fluid flow.

In order to enable the rapid exchange of the respective sealing elements differently designed for different operating phases, the configuration advantageously is devised such that the fastening members for sealing elements on the housing end side facing away from the bore hole are designed as bayonet catch members, wherein a rotatable bayonet ring connected to a, particularly hydraulic, actuator is preferably connected with the housing. With the appropriate configuration of the locking members the insertion and removal of sealing elements and/or supporting parts of the sealing elements is feasible in a particularly simple manner, especially by means of such a rotatable and hydraulically actuatable bayonet ring, wherein the configuration advantageously is devised such that the sealing elements are designed to be frustoconical, or are fixed in a frustoconical carrier, and the inner wall regions adjacent to the housing end side facing away from the bore hole are shaped in an accordingly hollow-conical manner. Such a configuration enables also high pressures to be reliably taken up, wherein it has to be feasible to reliably absorb also extremely high pressures bearing in mind the suspended arrangement and the fact that, for instance, a natural lake can be located above an ore deposit. In this respect, the configuration advantageously is devised such that the sealing elements capable of being fixed within the housing on its end side facing away from the bore hole are designed as shaft seals or rod seals constructed to seal rotatable and/or axially displaceable drill rods and/or tubes intended to supply pressure medium to excavation tools.

BRIEF DESCRIPTION OF THE SEVERAL VIEWS OF THE DRAWINGS

In the following, the invention will be explained in more detail by way of an exemplary embodiment represented in the drawing, which is to be used under the special operating conditions of the initially mentioned excavation method. In the drawing.

DETAILED DESCRIPTION OF THE INVENTION

Figure 1:
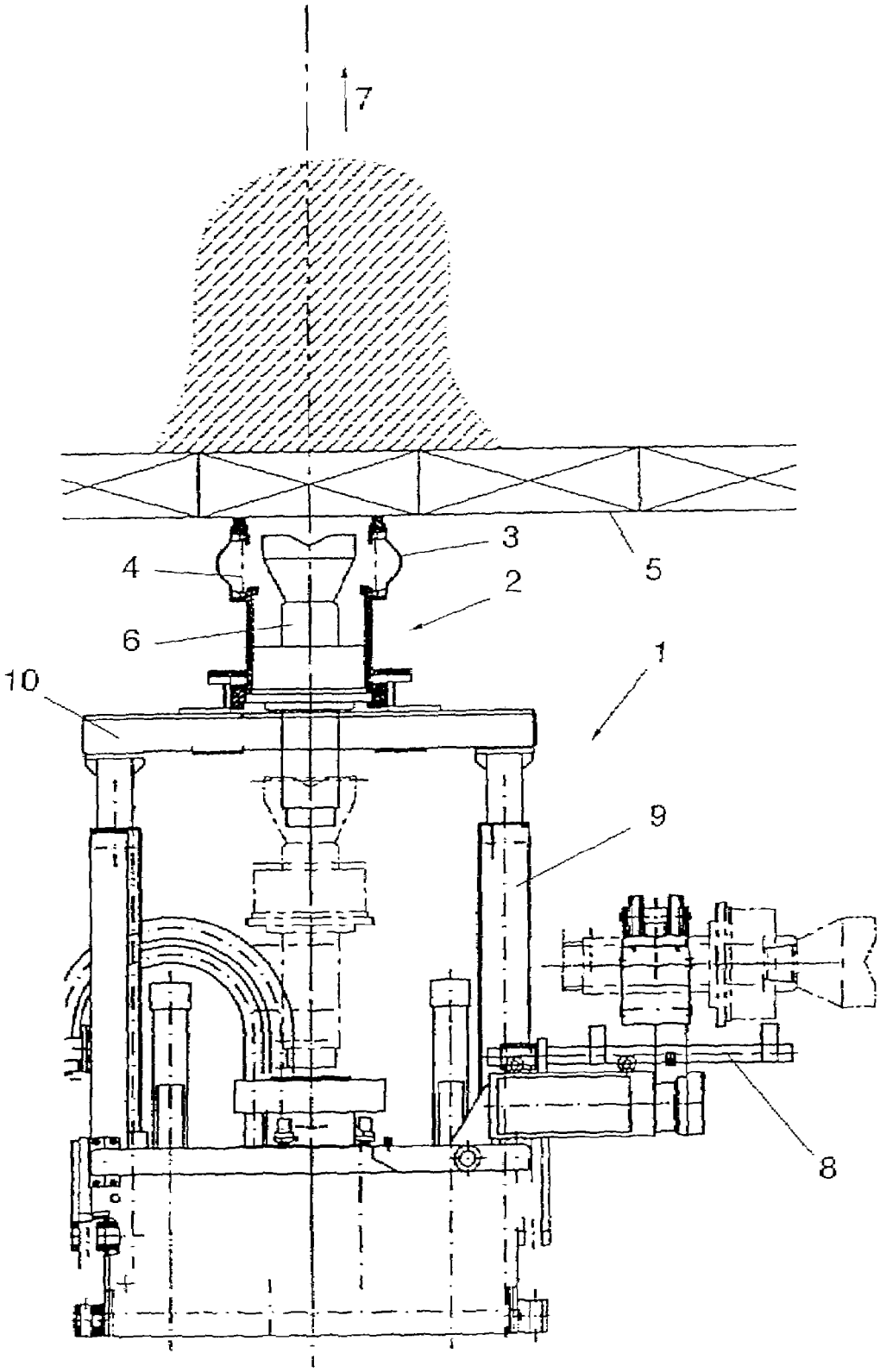
FIG. 1 is a partially sectioned schematic side view of the device according to the invention oriented towards a drilling station.

FIG. 1 schematically elucidates the starting phase of the excavation process extensively described in U.S. Pat. No. 5,380,127. The blow-out preventor 2 is fixed on a drilling frame 1 with an elastic sealing collar 3 being pressed at the lining 5 of the tunnel by means of a helical spring 4 and a drilling tool 6 being connected with the drilling station 1. The drilling tool 6 is then advanced in the sense of arrow 7, i.e., in the axial direction of the bore, whereby short extension pieces are each arranged between the actuator and the drill bit in the drilling station 1. In this phase, the sealing collar 3 safeguards perfect dust sealing relative to the tunnel lining, wherein a manipulator 8 is additionally apparent from the illustration according to FIG. 1, which serves to pivot the drilling tool and the extension rods into the respective positions in the interior of the drilling station. The drilling station 1 comprises hydraulic cylinder-piston units 9 to adjust the height position, whereby, during the extension of a drill rod assembly, the respective drill rod assembly already driven in is held in the region of the platform 10, for instance by clamps or claws not illustrated, such that the respective extension piece can be installed therebelow.

Figure 2:
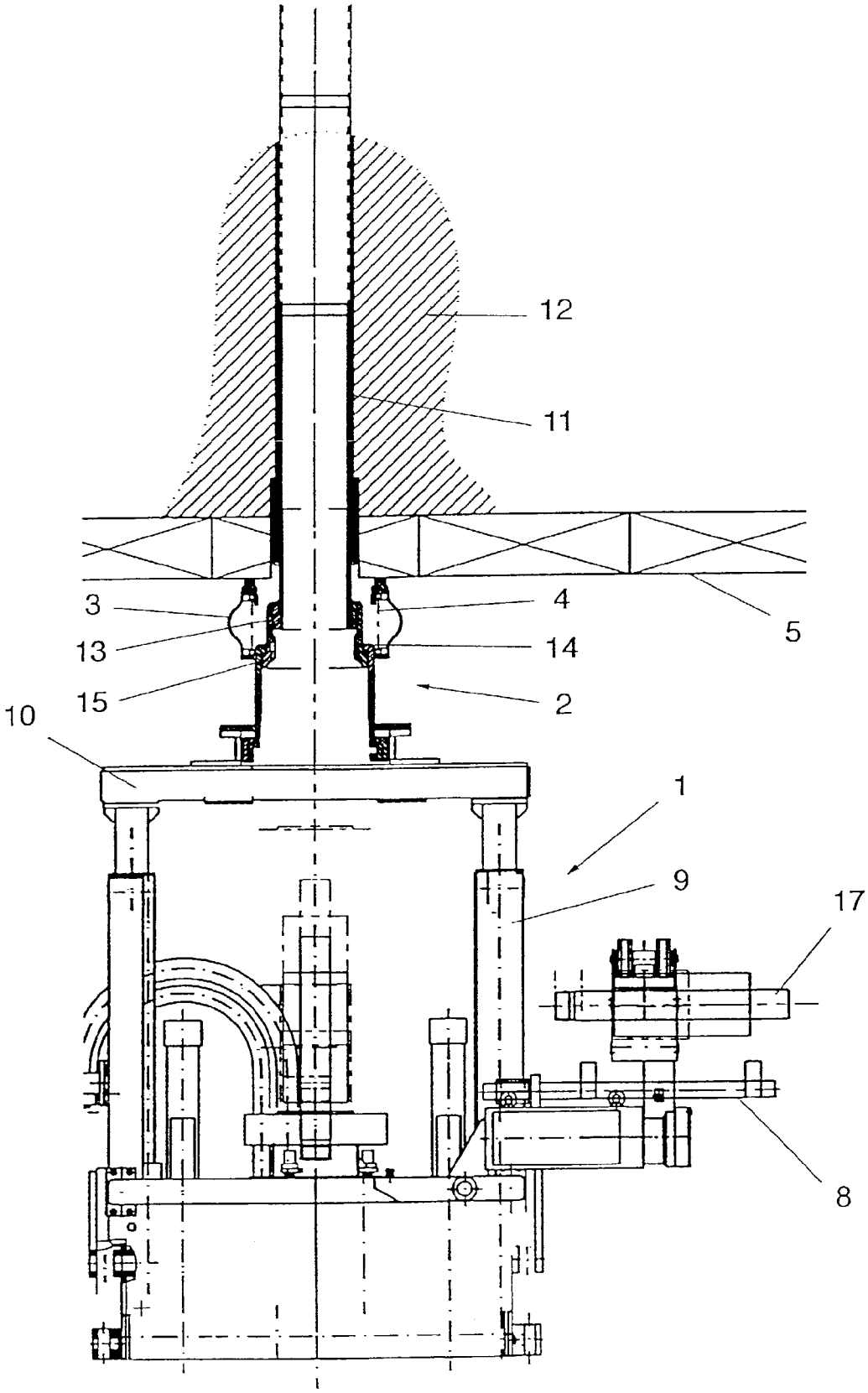
FIG. 2 is an illustration analogous to FIG. 1 upon insertion of the sealing flange.
Figure 3:
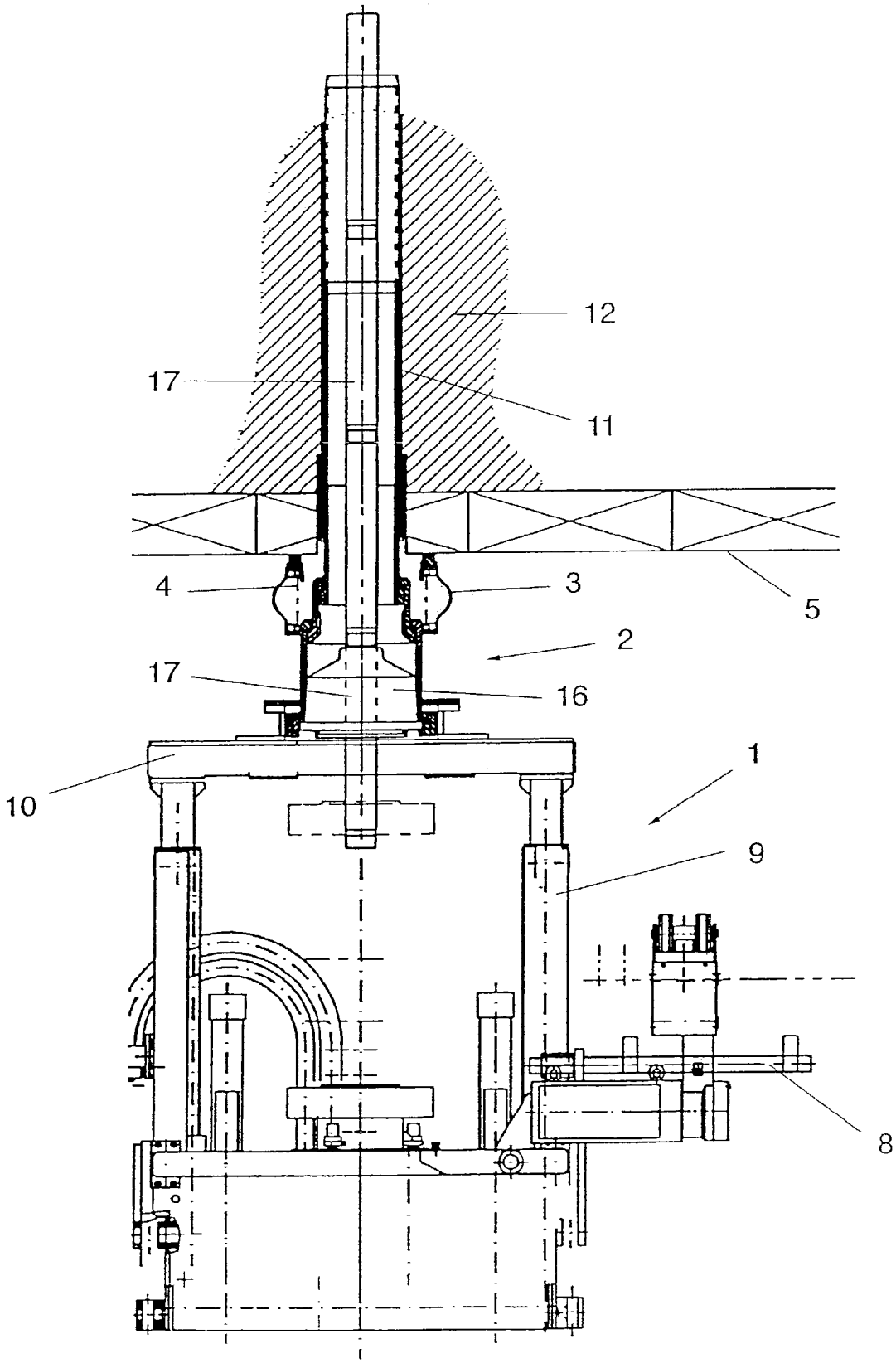
FIG. 3 is an illustration analogous to FIGS. 1 and 2 upon introduction of the tubing intended for jet boring.

In the illustration according to FIG. 2, the drill rod assembly has already been removed again and a bore hole lining 11 has been introduced into the bore hole. In the region adjacent to the tunnel lining, the material is secured by concrete injections 12, and subsequently a sealing flange 13 is screwed with the lower part of the bore hole lining 11. The blow-out preventor 2 is supported via inwardly oriented flanges 14 on an accordingly outwardly oriented annular brim 15 of the sealing flange 13 so as to be held suspended from the rock. In addition, the sealing collar 3 is again provided and pressed against the tunnel lining 5 by helical springs 4. In this phase, the housing of the blow-out preventor 2 is connected with the bore hole lining 11 in a pressure-proof and tight manner, and the respective supply tubes for the hydraulic excavation process, i.e. jet boring, can be introduced via the manipulator 8. In this phase, a suitable high-pressure-proof seal 16 is fixed to the housing end side of the bore-hole preventor 2 facing away from the bore hole, as is apparent particularly from FIG. 3, so as to enable the supply tubes 17 for pressure fluid to be sealingly inserted into the bore hole tubing 11.

Figure 4:
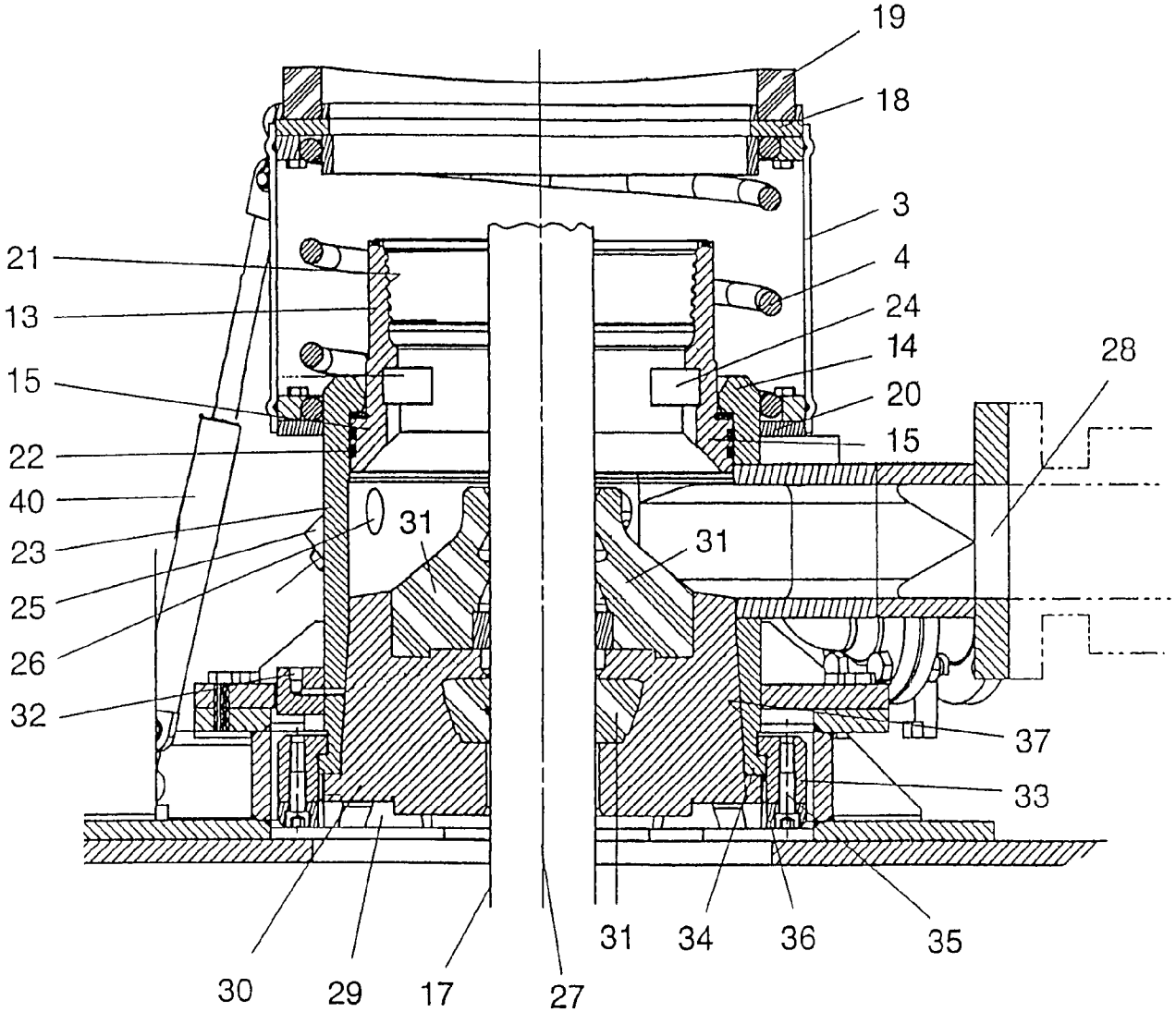
FIG. 4 is an axial section through the device according to FIG. 3 with an inserted high-pressure.

The structural details are more clearly visible in FIGS. 4 to 7. FIG. 4 clearly depicts the arrangement and support of the helical spring 4 for the resilient application of the collar 3 at the tunnel lining. To this end, a front plate 18 is provided with an appropriate peripheral seal 19 on which one end of the spring 4 is supported, whose other end bears against an annular flange 20 firmly connected with the housing. The sealing flange 13, which carries an internal thread 21 to be screwed with the bore hole lining 11, is sealingly mounted relative to the housing 23 of the blow-out preventor by means of sealing rings 22, said mounting enabling a rotation of the sealing flange 13 without any loss of its sealing effect, application sites for suitable tools being schematically indicated at 24.

From FIG. 4, further connections 25 to flushing nozzles 26 are apparent, whose spraying axes intersect with the axis 27 of the bore hole and tubes so as to enable material adhering to the outer shells of the tubes 17 to be flushed off towards the discharge opening 28 upon axial displacement of the tubes 17.

To this discharge opening is connected the rigid tubing provided in the interior of the tunnel.

The high-pressure-proof sealing element 29 comprises a support 30 with which elastomer sealing rings 31 are connected. To enhance the sealing effect, flushing channels 32 are provided, by which hollow spaces between sealing elements and the rod assembly can be kept under an overpressure so as to prevent drill cuttings from penetrating into the same and enable optionally penetrating material to be flushed out.

By 33 is denoted a two-part ring which surrounds a mating annular flange 34 to which a bayonet ring 36 is fixed by screw bolts 35. The support 30 of the sealing elements 31 comprises appropriate bayonet recesses and projections, respectively, and itself is conically designed such that, by turning the bayonet ring 36, not only an axial securement of the sealing elements is ensured but also an axial pressure will simultaneously be exerted on the sealing elements. Since the outer jacket of the support 30 of the sealing elements are designed to be frustoconical, as can be seen at 37, and the mating counter wall of the housing 23 is designed to be conical, a highly firm and tight fixation of the sealing elements will be ensured.

Figure 5:
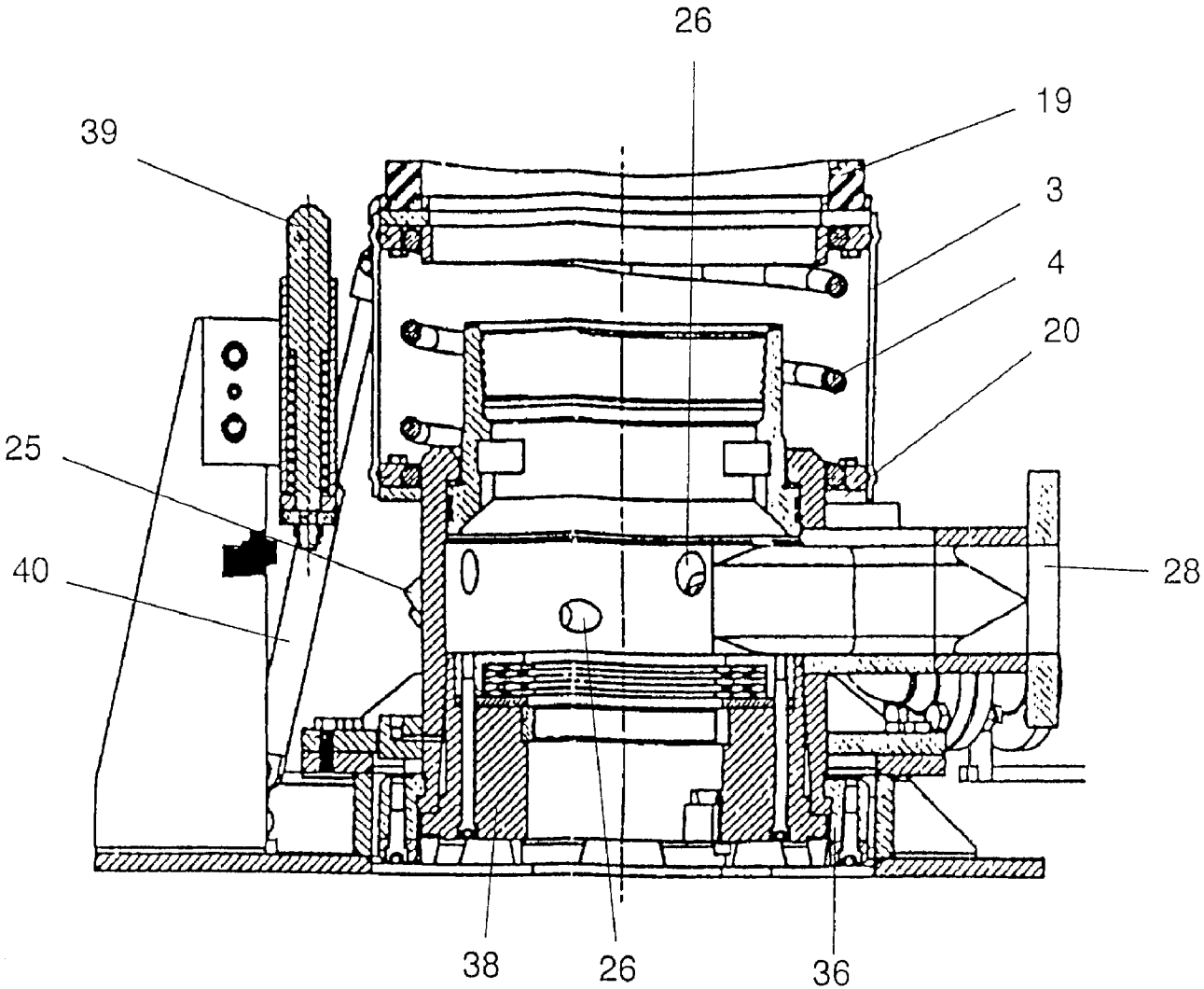
FIG. 5 is an illustration corresponding to that of FIG. 4 with a simple dust seal provided for the rod assembly.

In the illustration according to FIG. 5, only the simple dust seal is provided, the sealing elements 30, 31 thus being replaced with a simple-structured sealing element 38, which is fixed by the bayonet ring 36. By this equipment drilling can be advanced, whereby the differently oriented spraying nozzles 26 are apparent from the illustration according to FIG. 5. Laterally beside the sealing collar 3 is a spring-loaded tracer pin 39, which serves measuring and calibration purposes. Furthermore, the illustration according to FIG. 5 depicts a hydraulic cylinder-piston unit 40, which, in addition to the force of the spring 4, helps to keep the sealing element 19 and the collar 3 in their sealing positions at the tunnel lining.

Figure 6:
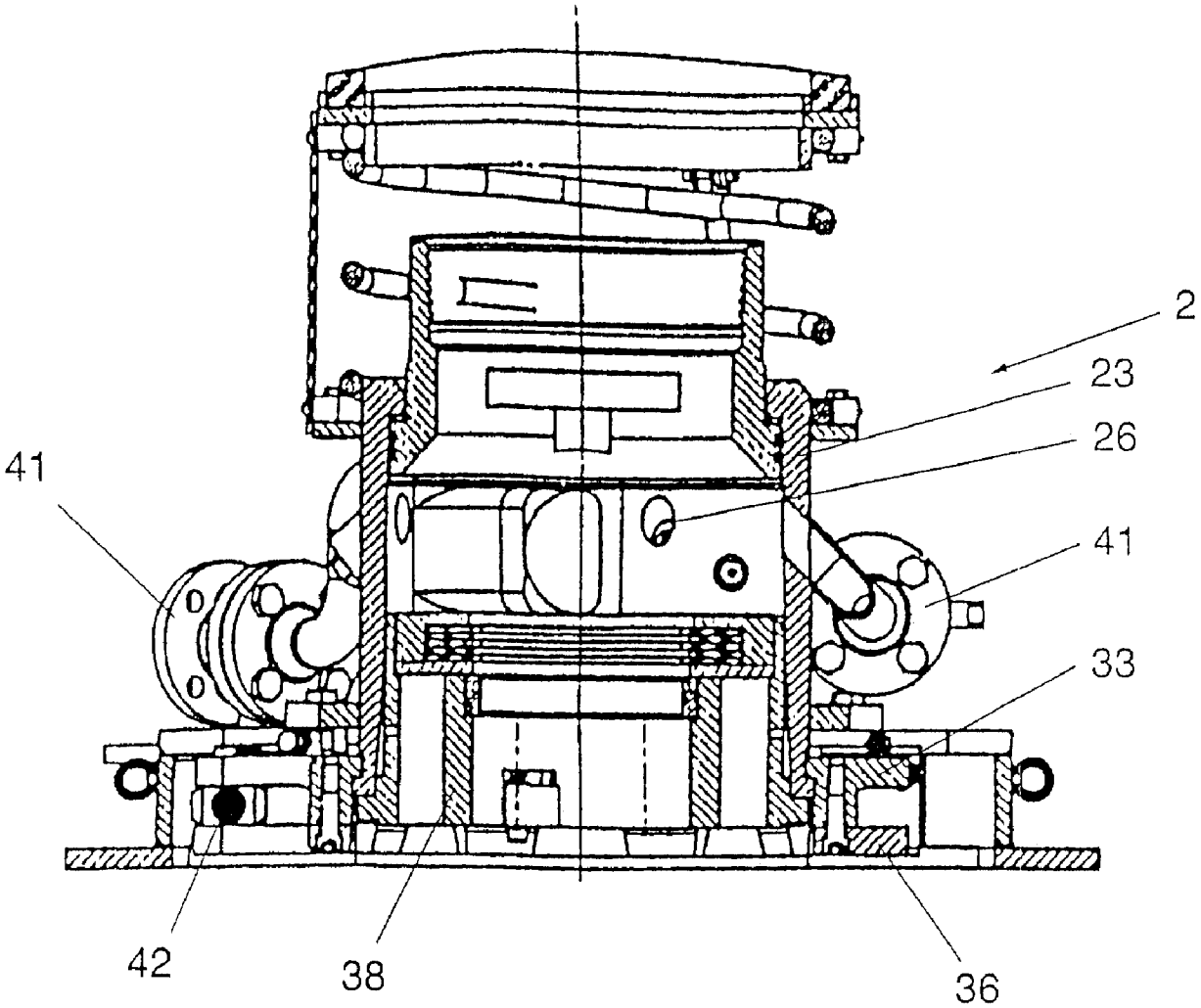
FIG. 6 is a section according to FIG. 5, showing the respective connections for the adjustment of the bayonet ring and the supply of flushing medium to the flushing nozzles, respectively.
Figure 7:
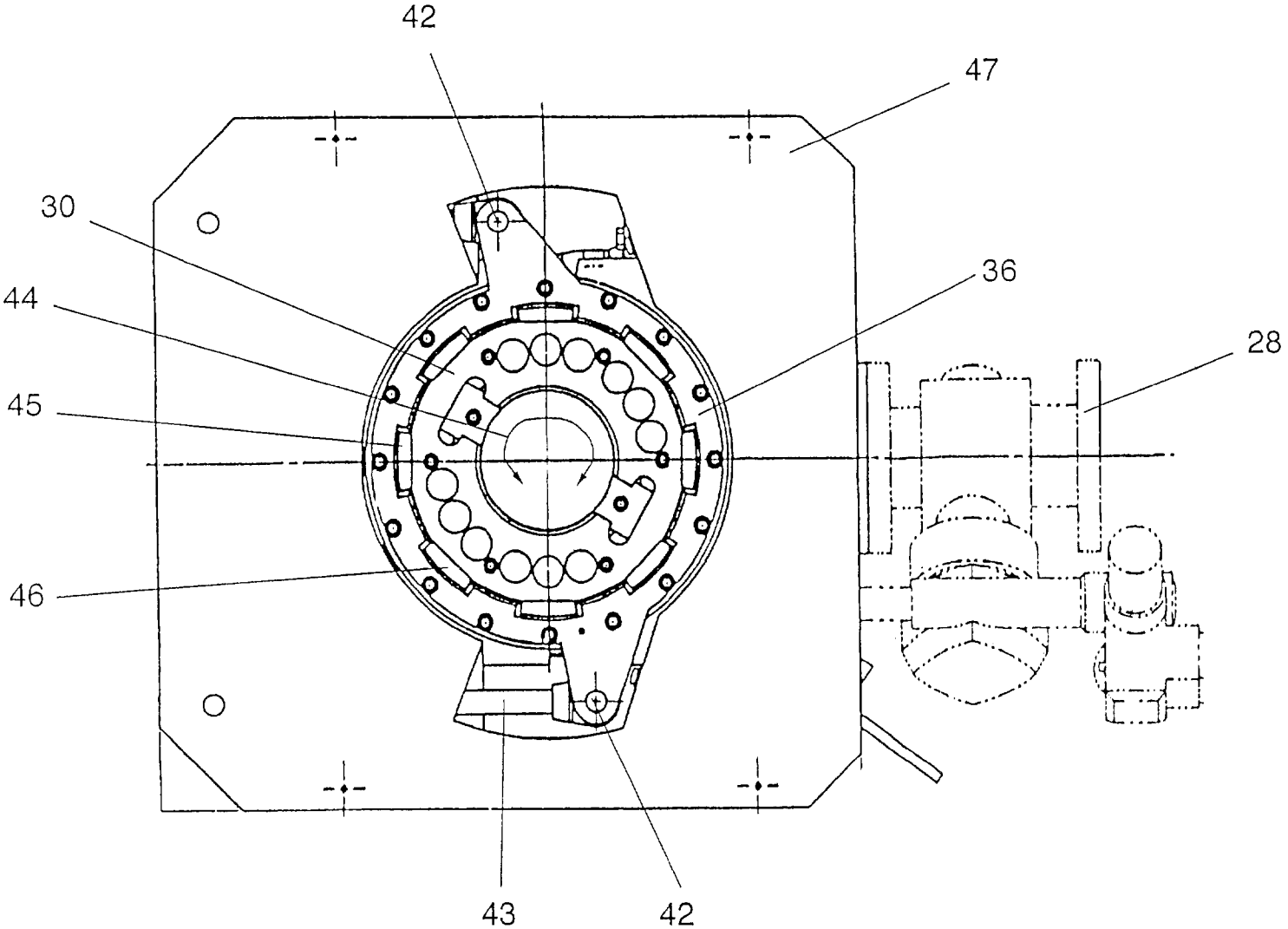
FIG. 7 is a top view on the closure ring used to fix the sealing elements.

As is apparent from FIG. 6, tube flanges 41 are arranged laterally of the housing 23 of the blow-out preventor 2, which tube flanges serve to feed flushing medium to the nozzles 26. FIG. 6, furthermore, depicts the mounting of the bayonet ring 33, 36 and a hinge point 42 for a cylinder-piston unit that serves to rotate said bayonet ring in order to release or fix said sealing elements. The details of the pivotability of the bayonet ring are visible from FIG. 7, which illustrates the bayonet ring 36 from below. By means of the rod assembly 43 of a hydraulic cylinder-piston unit, it is feasible to pivot the bayonet ring in the sense of double arrow 44 such that the respective bayonet recesses 45 are either brought into alignment with the respective projections 46 of the respectively inserted sealing element or, upon pivoting via wedge surfaces provided on the projections 46, exert an appropriate axial pressure force on the sealing elements. In the illustration according to FIG. 7, the support 30 of the high-pressure safety element is visible from below, wherein the base plate of the blow-out preventor serving to fix the plate 10 to the drilling station 1 is denoted by 47.

What is claimed is:

1. A device for sealing a bore hole and discharging drill cuttings and stripped excavation material, comprising a housing adapted to receive sealing elements and an opening capable of being connected to the bore hole, wherein a side wall of the housing is provided with at least one opening for the connection of a haulage duct (17) and wherein the housing has an end side facing the bore hole, which end side is equipped with a screwable sealing flange (13) for detachable connection with a bore hole lining (11), wherein the sealing flange (13) is rotationally and sealingly mounted within the housing and carries an annular brim (15) which is overlapped by a stop of the housing.

2. A device according to claim 1, wherein the sealing flange (13) is surrounded by a sealing collar (3) capable of being pressed against an edge of the bore hole in the direction of the axis (27) of the bore hole.

3. A device according to claim 2, wherein connections (25) for flushing nozzles (26) run into the interior of the housing on the side wall of the housing.

4. A device according to claim 3, wherein at least one of the flushing nozzles (26) in the interior of the housing is directed onto a rod assembly or a conveyor tube intended to introduce excavation fluid to a fluid-operated excavation head.

5. A device according to claim 4, wherein at least one of the flushing nozzles (26) in the interior of the housing is oriented towards the haulage duct (17) in the tangential direction.

6. A device according to claim 3, wherein at least one of the flushing nozzles (26) in the interior of the housing is oriented towards the haulage duct (17) in the tangential direction.

7. A device according to claim 2, wherein fastening members designed as bayonet catch members (45) are provided on an end side of the housing facing away from the bore hole for the sealing elements (31).

8. A device according to claim 2, wherein a rotatable bayonet ring (36) connected to an actuator (43) is connected with the housing.

9. A device according to claim 2, wherein the sealing elements (29, 31) are capable of being fixed within the housing in a position on an end side of the housing facing away from the bore hole and are designed as seals constructed to seal drill rods.

10. A device according to claim 9, wherein the sealing elements (16, 29, 31) are designed to be frustoconical, or are fixed in a frustoconical carrier, and inner-wall regions adjacent to the housing end side facing away from the bore hole are shaped in an accordingly hollow-conical manner.

11. A device according to claim 2, wherein the sealing elements (29, 31) are capable of being fixed within the housing in a position on an end side of the housing facing away from the bore hole and are designed as seals constructed to seal tubes (17) for supplying pressure medium to excavation tools.

12. A device according to claim 11, wherein the sealing elements (16, 29, 31) are designed to be frustoconical, or are fixed in a frustoconical carrier, and inner-wall regions adjacent to the housing end side slicing away from the bore hole are shaped in an accordingly hollow-conical manner.

13. A device according to claim 2, wherein the sealing elements (29, 31) are capable of being fixed within the housing in a position on an end side of the housing facing away from the bore hole and are designed as seals constructed to seal drill rods and tubes (17) for supplying pressure medium to excavation tools.

14. A device according to claim 13, wherein the sealing elements (16, 29, 31) are designed to be frustoconical, or are fixed in a frustoconical carrier, and inner-wall regions adjacent to the housing end side facing away from the bore hole are shaped in an accordingly hollow-conical manner.

15. A device according to claim 2, wherein a pressure spring (4) is arranged concentric with the sealing collar (3) surrounding the sealing flange (13), between the housing and a seal capable of being applied against an edge of the bore hole.

16. A device according to claim 1, wherein connections (25) for flushing nozzles (26) run into the interior of the housing on the side wall of the housing.

17. A device according to claim 16, wherein at least one of the flushing nozzles (26) in the interior of the housing is directed onto a rod assembly or a conveyor tube intended to introduce excavation fluid to a fluid-operated excavation head.

18. A device according to claim 17, wherein at least one of the flushing nozzles (26) in the interior of the housing is oriented towards the haulage duct (17) in the tangential direction.

19. A device according to claim 17, wherein fastening members designed as bayonet catch members (45) are provided on an end side of the housing facing away from the bore hole for the sealing elements (31).

20. A device according to claim 17, wherein a rotatable bayonet ring (36) connected to an actuator (43) is connected with the housing.

21. A device according to claim 17, wherein the sealing elements (29, 31) are capable of being fixed within the housing in a position on an end side of the housing facing away from the bore hole and are designed as seals constructed to seal drill rods.

22. A device according to claim 17, wherein the sealing elements (29, 31) are capable of being fixed within the housing in a position on an end side of the housing facing away from the bore hole and are designed as seals constructed to seal tubes (17) for supplying pressure medium to excavation tools.

23. A device according to claim 17, wherein the sealing elements (29, 31) are capable of being fixed within the housing in a position on an end side of the housing facing away from the bore hole and are designed as seals constructed to seal drill rods and tubes (17) for supplying pressure medium to excavation tools.

24. A device according to claim 17, wherein a pressure spring (4) is arranged concentric with the sealing collar (3) surrounding the sealing flange (13), between the housing and a seal capable of being applied against an edge of the bore hole.

25. A device according to claim 16, wherein at least one of the flushing nozzles (26) in the interior of the housing is oriented towards the haulage duct (17) in the tangential direction.

26. A device according to claim 25, wherein fastening members designed as bayonet catch members (45) are provided on an end side of the housing facing away from the bore hole for the sealing elements (31).

27. A device according to claim 25, wherein a rotatable bayonet ring (36) connected to an actuator (43) is connected with the housing.

28. A device according to claim 25, wherein a pressure spring (4) is arranged concentric with the sealing collar (3) surrounding the sealing flange (13), between the housing and a seal capable of being applied against an edge of the bore hole.

29. A device according to claim 16, wherein fastening members designed as bayonet catch members (45) are provided on an end side of the housing facing away from the bore hole for the sealing elements (31).

30. A device according to claim 16, wherein a rotatable bayonet ring (36) connected to an actuator (43) is connected with the housing.

31. A device according to claim 16, wherein the sealing elements (29, 31) are capable of being fixed within the housing in a position on an end side of the housing facing away from the bore hole and are designed as seals constructed to seal drill rods.

32. A device according to claim 31, wherein the sealing elements (16, 29, 31) are designed to be frustoconical, or are fixed in a frustoconical carrier, and inner-wall regions adjacent to the housing end side facing away from the bore hole are shaped in an accordingly hollow-conical manner.

33. A device according to claim 16, wherein the sealing elements (29, 31) are capable of being fixed within the housing in a position on an end side of the housing facing away from the bore hole and are designed as seals constructed to seal tubes (17) for supplying pressure medium to excavation tools.

34. A device according to claim 33, wherein the sealing elements (16, 29, 31) are designed to be frustoconical, or are fixed in a frustoconical carrier, and inner-wall regions adjacent to the housing end side facing away from the bore hole are shaped in an accordingly hollow-conical manner.

35. A device according to claim 16, wherein the sealing elements (29, 31) are capable of being fixed within the housing in a position on an end side of the housing facing away from the bore hole and are designed as seals constructed to seal drill rods and tubes (17) for supplying pressure medium to excavation tools.

36. A device according to claim 35, wherein the sealing elements (16, 29, 31) are designed to be frustoconical, or are fixed in a frustoconical carrier, and inner-wall regions adjacent to the housing end side facing away from the bore hole are shaped in an accordingly hollow-conical manner.

37. A device according to claim 16, wherein a pressure spring (4) is arranged concentric with the sealing collar (3) surrounding the sealing flange (13), between the housing and a seal capable of being applied against an edge of the bore hole.

38. A device according to claim 1, wherein fastening members designed as bayonet catch members (45) are provided on an end side of the housing facing away from the bore hole for the sealing elements (31).

39. A device according to claim 38, wherein a rotatable bayonet ring (36) connected to an actuator (43) is connected with the housing.

40. A device according to claim 38, wherein a pressure spring (4) is arranged concentric with the sealing collar (3) surrounding the sealing flange (13), between the housing and a seal capable of being applied against an edge of the bore hole.

41. A device according to claim 1, wherein a rotatable bayonet ring (36) connected to an actuator (43) is connected with the housing.

42. A device according to claim 41, wherein a pressure spring (4) is arranged concentric with the sealing collar (3) surrounding the sealing flange (13), between the housing and a seal capable of being applied against an edge of the bore hole.

43. A device according to claim 1, wherein the sealing elements (29, 31) are capable of being fixed within the housing in a position on an end side of the housing facing away from the bore hole and are designed as seals constructed to seal drill rods.

44. A device according to claim 43, wherein the sealing elements (16, 29, 31) are designed to be frustoconical, or are fixed in a frustoconical carrier, and inner-wall regions adjacent to the housing end side facing away from the bore hole are shaped in an accordingly hollow-conical manner.

45. A device according to claim 43, wherein a pressure spring (4) is arranged concentric with the sealing collar (3) surrounding the sealing flange (13), between the housing and a seal capable of being applied against an edge of the bore hole.

46. A device according to claim 1, wherein the sealing elements (29, 31) are capable of being fixed within the housing in a position on an end side of the housing facing away from the bore hole and are designed as seals constructed to seal tubes (17) for supplying pressure medium to excavation tools.

47. A device according to claim 46, wherein the sealing elements (16, 29, 31) are designed to be frustoconical, or are fixed in a frustoconical carrier, and inner-wall regions adjacent to the housing end side facing away from the bore hole are shaped in an accordingly hollow-conical manner.

48. A device according to claim 1, wherein the sealing elements (29, 31) are capable of being fixed within the housing in a position on an end side of the housing facing away from the bore hole and are designed as seals constructed to seal drill rods and tubes (17) for supplying pressure medium to excavation tools.

49. A device according to claim 48, wherein the sealing elements (16, 29, 31) are designed to be frustoconical, or are fixed in a frustoconical carrier, and inner-wall regions adjacent to the housing end side facing away from the bore hole are shaped in an accordingly hollow-conical manner.

50. A device according to claim 1, wherein a pressure spring (4) is arranged concentric with the sealing collar (3) surrounding the sealing flange (13), between the housing and a seal capable of being applied against an edge of the bore hole.

* * * * *